US006009891A

United States Patent [19]

Surface et al.

[11] Patent Number: 6,009,891

[45] Date of Patent: Jan. 4, 2000

[54] UMBRELLA SCREEN

[75] Inventors: Andria Surface; Faith Decker, both of Wilmette; Kenneth Fanti, Northfield, all of Ill.

[73] Assignee: North Shore Easy Living, Inc., Northfield, Ill.

[21] Appl. No.: 09/008,423

[22] Filed: Jan. 16, 1998

Related U.S. Application Data

[60] Provisional application No. 60/046,808, May 2, 1997.

[51] Int. Cl.[7] ..... A45B 15/00

[52] U.S. Cl. ..... 135/98; 135/90; 135/96; 135/115; 135/119; 135/120.1; 135/913; 135/16; 52/3

[58] Field of Search ..... 52/3; 135/90, 96, 135/98, 115, 119, 120.1, 120.4, 913, 16; 5/414, 512, 122, 121; 2/4

[56] References Cited

U.S. PATENT DOCUMENTS

| | | | |
|---|---|---|---|
| 44,482 | 9/1864 | Clarke . | |
| 90,050 | 5/1869 | Rodgers . | |
| 560,245 | 5/1896 | Wagner . | |
| 574,091 | 12/1896 | Irvine, Jr. . | |
| 645,890 | 3/1900 | Conrad | 135/90 X |
| 734,311 | 7/1903 | Ferroussat . | |
| 1,774,909 | 9/1930 | Wells . | |
| 2,113,118 | 4/1938 | Pyatt . | |
| 2,502,984 | 4/1950 | Parmenter . | |
| 2,546,228 | 3/1951 | Martini . | |
| 2,943,634 | 7/1960 | Morgan . | |
| 3,004,592 | 10/1961 | Norton . | |
| 3,406,698 | 10/1968 | Hutchison | 135/119 X |
| 3,419,024 | 12/1968 | Nickerson, Jr. | 135/120.1 X |
| 3,477,453 | 11/1969 | D'Ulisse et al. . | |
| 5,172,712 | 12/1992 | Robinson . | |
| 5,430,980 | 7/1995 | Ferrier | 135/90 X |
| 5,664,595 | 9/1997 | Vonderhorst et al. | 135/90 X |
| 5,673,444 | 10/1997 | Middendorf | 5/122 X |
| 5,678,587 | 10/1997 | Bilotti | 135/16 X |

FOREIGN PATENT DOCUMENTS

| | | | |
|---|---|---|---|
| 274284 | 7/1927 | United Kingdom | 135/115 |

OTHER PUBLICATIONS

Advertisement for small/large Umbrella Screen, 1 sheet.

*Primary Examiner*—Beth Aubrey
*Assistant Examiner*—Brian E. Glessner
*Attorney, Agent, or Firm*—Niro, Scavone, Haller & Niro

[57] ABSTRACT

An umbrella screen enclosure system for use with an outdoor umbrella providing a tether system that is attachable to the umbrella and is configured to form an exoskeleton over the umbrella. The exoskeleton is formed by affixing a plurality of individual tethers to the umbrella and over the spines of the umbrella. Also provided is a screening system that is attached to the exoskeleton by the use of coacting fasteners.

10 Claims, 2 Drawing Sheets

UMBRELLA SCREEN

This application is based upon Provisional Application Serial No. 60/046,808 which was filed on May 2, 1997.

BACKGROUND OF THE INVENTION

The invention relates to a screen enclosure system. More specifically, the invention is comprised of a tether system that is capable of being mounted to a standard outdoor umbrella and a screening system that completes the enclosure.

SUMMARY OF THE INVENTION

An object of our invention is to provide a screen enclosure system that may be used with standard outdoor umbrellas to form an outdoor umbrella gazebo that forms a completely screened-in enclosure. To accomplish this, our invention provides a tether system which attaches to a pre-existing outdoor umbrella. The tether system is comprised of plurality of individual tethers that are attached at one end to a ring which fits over the umbrella's finial and are placed over the pre-existing spines of the outdoor umbrella. The other end of each tether has a loop that fits over the distal ends of the umbrella's spines.

Once the tether system is in place, screening is affixed to the tether system by affixing along one edge of a rectangular piece of screening equally spaced hooks that are then affixed to the loops of the tether. The edge of the screening also includes an elastic band that forms a snug fit with the pre-existing umbrella and the opposing edge may be weighted. A zipper or some other coacting fastening means may be affixed to the opposing vertical ends to seal the enclosure.

BRIEF DESCRIPTION OF THE DRAWINGS

These and other features, objects and advantages of the present invention will become apparent from the following description and drawings wherein like reference numerals represent like elements in the several views, and in which.

DETAILED DESCRIPTION OF THE PREFERRED EMBODIMENTS

Figure 1:
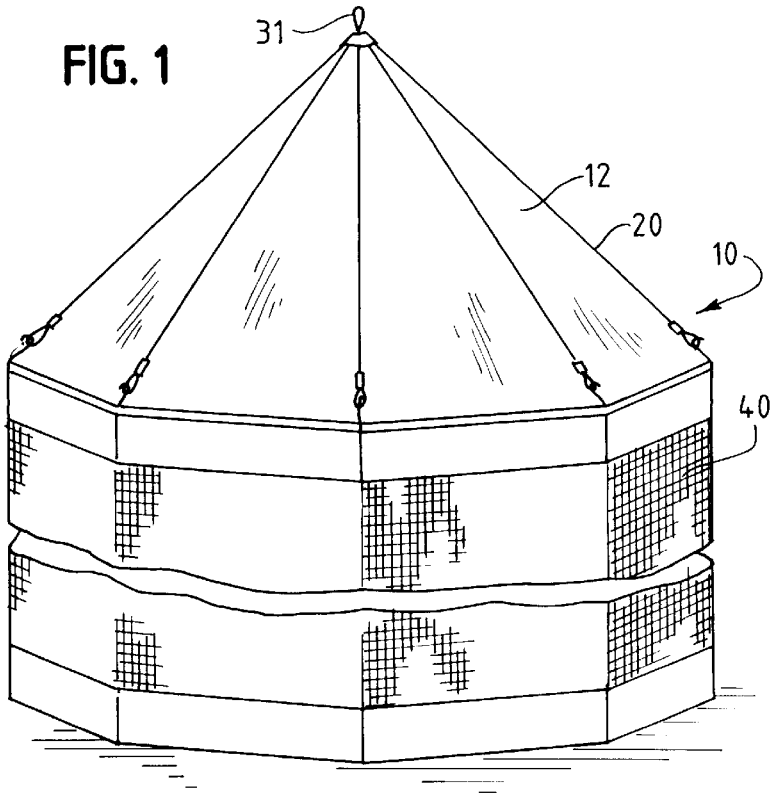
FIG. 1 is a perspective view of the invention showing the invention fully assembled.

As shown in FIG. 1, the present invention provides a screening enclosure 10 that is attachable to a standard outdoor umbrella 12. To fully enclose umbrella 12, a tether system 20 and a screening system 40 is provided.

Figure 2:
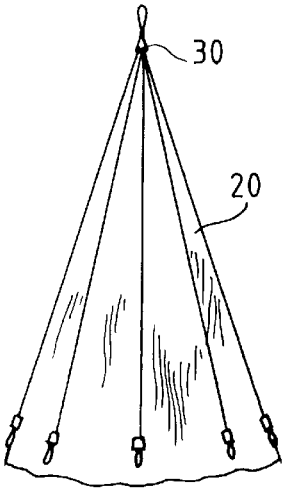
FIG. 2 is a perspective view of the tether system.
Figure 3:
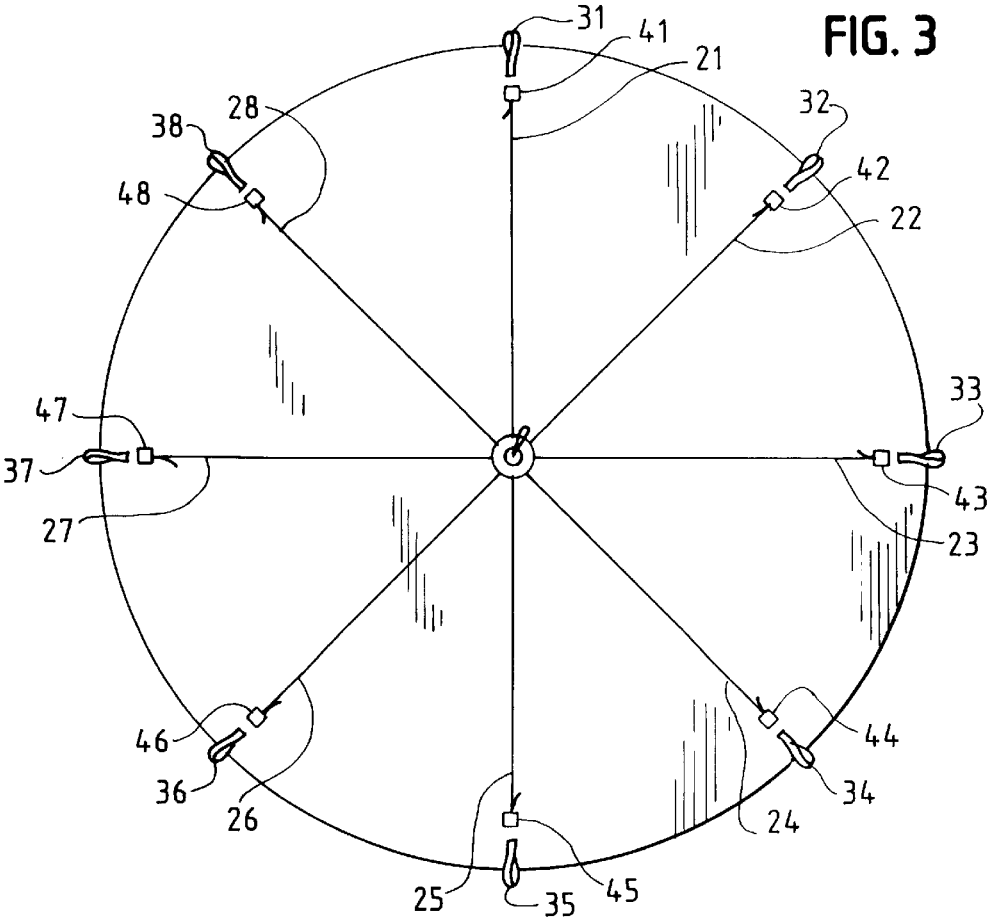
FIG. 3 is a top view of the tether system shown in FIG. 2.
Figure 4:
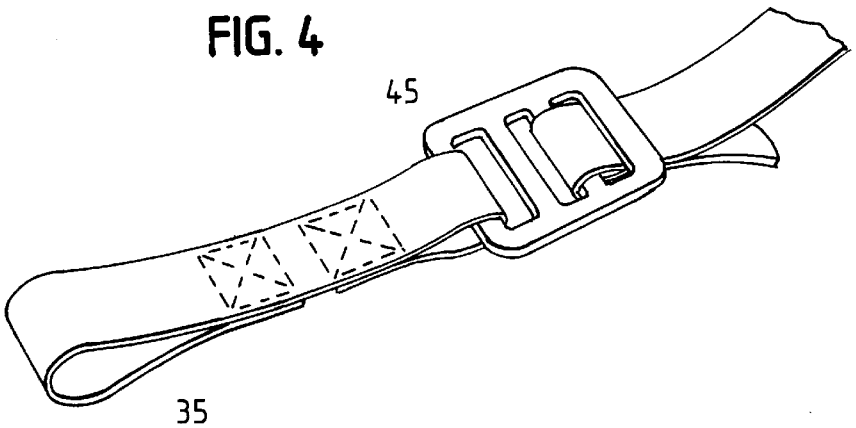
FIG. 4 is an exploded perspective of the distal end of an individual tether.

As shown in FIGS. 2 and 3, tether system 20 is typically comprised of eight individual tethers 21–28 that are affixed to a ring 30 at their proximal ends. As shown in FIGS. 2–4, the distal end of each tether 21–28 includes a loop 31–38. The length of each tether may be adjusted through the use of buckles 41–48.

Figure 5:
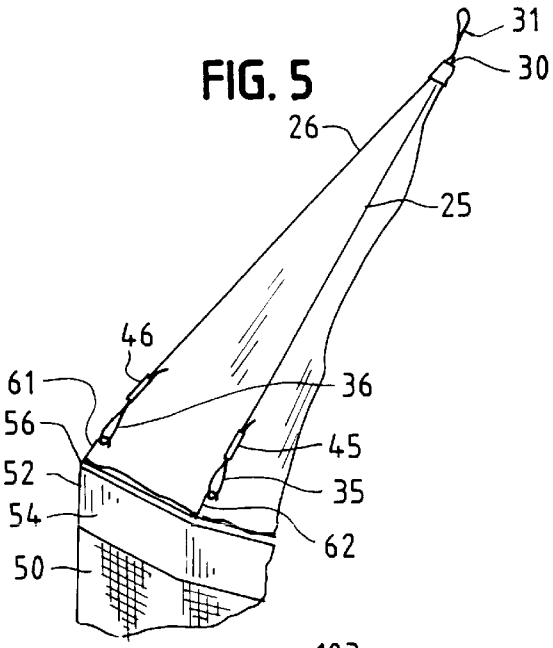
FIG. 5 is an exploded view showing how the screening system is affixed to the tether system.
Figure 6:
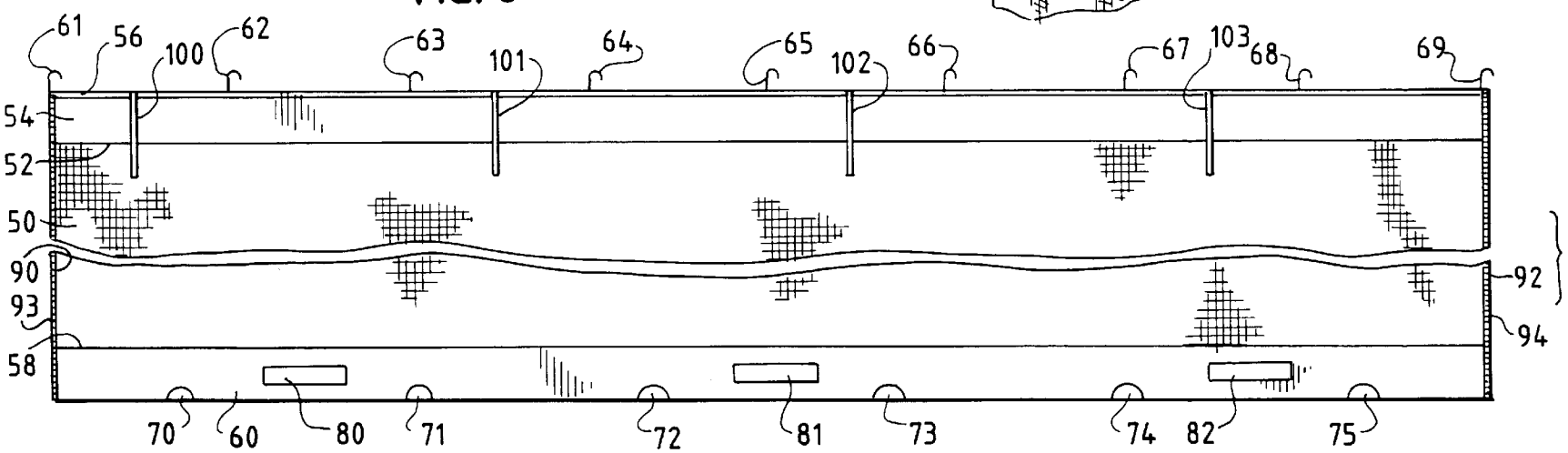
FIG. 6 is a front view of the screening system.

As shown in FIGS. 5 and 6, screening system 40 is comprised of a rectangular screen mesh 50 having at is upper edge 52 a band of cloth or canvass 54, elastic band 56, and equally spaced hooks 61–69. At the opposingly located lower edge 58 a cloth or canvass band 60 is also provided. To add weight to lower edge 58 weights 70–75 may be sewn into band 58. In addition, pockets 80–82 may also be added in which bricks or other heavy objects may be placed to increase the overall weight. Opposing vertical edges 90 and 92 include mating zippers 93 and 94.

In use, to enclosed a standard outdoor umbrella, tether system 20 is affixed to umbrella 12 by first placing ring 30 over the finial 31 of the umbrella. Tethers 21–28, which may be made of canvass, nylon or some other environmentally resistant material, are then positioned over the spines of umbrella 12. Loops 31–38 are then placed over the ends of the spines and the length of tethers 21–28 are adjusted to form a secure/taught fit over the spines through the manipulation of buckles 41–48. Buckles 41–48 also allow tether system to be used with a wide variety of different diameter umbrellas. This is especially useful since the most common sizes of outdoor umbrellas are 7 and 9 feet in diameter.

Once tether system is in place, it forms an exoskeleton over the umbrella which supports screening system 40. Moreover, by constructing tether system from weather resistant materials, it need not be removed once affixed to umbrella 12. In addition, the tensioning of each individual tether prevents wind from lifting the screening tether system off of umbrella 12.

Screening system 40 is affixed to the exoskeleton formed by tether system 20 through the use of hooks 61–69. As shown in FIG. 5, the hooks are placed through the loops formed at the distal end of each tether in order to completely surround umbrella 12.

Of course, persons of skill in the art would recognize that to affix screen system 40 to the exoskeleton formed by tether system 20, a wide variety of fasteners or coacting fastening systems may be used. Alternate fasteners would include, but are not limited to, buttons, snaps, tie-downs, VELCRO and other fastening means.

Elastic band 56, which is sewn into band 54, helps keep band 54 snug against umbrella 12. Moreover, for use with smaller diameter umbrellas, band 54 may also include a series of pleats or darts which help hide any excess material and provides a more attractive appearance.

A plurality of weights 70–75 may be sewn into band 58 in order to a keep screen system 40 hanging straight. Moreover, in windy conditions, a plurality of pockets 80–82 may be filled with additional weight.

To complete the enclosure, edges 90 and 92 are affixed together by a zipper. But, again, other coacting fastening systems such as buttons, snaps, and tie-downs may be used. Moreover, the embodiment shown consists of one continuous piece of screening. If desired, a plurality interconnecting panels may be used as well.

Lastly, tie-straps 100–103 may depend from upper edge 52. The tie-straps may be used to secure portions of screening up against edge 52 in order to create a partially closed and open enclosure.

It should be understood that various changes and modifications to the preferred embodiment described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. An umbrella enclosure system for use with a patio umbrella supported on a ground, wherein said patio umbrella has a plurality of spines and a finial, comprising:

a tether system that is attachable to said umbrella and is configured to form an exoskeleton over said umbrella by providing a plurality of adjustably positionable individual tethers that are affixable, by closed loops, to said umbrella and over said plurality of spines;

the length of each of said individual tethers is adjustable;

said exoskeleton is releasably securable to said spines to resist upward pressure and to support a screening system, wherein said screening system comprises a screen meshing;

said screening system is attachable to said exoskeleton by coacting fasteners so that said screening system is adapted to form a complete enclosure around said umbrella and further to define an opening for permitting access into said enclosure.

2. The device of claim 1 further including a ring to which proximal ends of said tethers are affixed and said ring is sized to fit over said finial.

3. The device of claim 1 further including weights located on said screening system.

4. An umbrella enclosure system, for enclosing a patio umbrella having a plurality of spines and a finial, comprising:

a tether system adapted to form an exoskeleton over said patio umbrella wherein the tether system comprises a plurality of individual tethers that are connectable at proximal ends to said finial of said umbrella and are positionable over said spines of said umbrella and are affixable at distal ends to said spines; and a screening system adapted to surround said umbrella, said screening system including screen meshing that is framed by an upper edge, an opposingly located lower edge, and two opposingly located side edges, wherein said upper edge has a plurality of fasteners spaced along said edge adapted to affix said screening system to said exoskeleton formed by said tether system.

5. The device of claim 4 further including a ring to which said proximal ends of said plurality of tethers are affixed, said ring sized to fit over said finial.

6. The device of claim 5 further including a loop located on the distal end of each of said plurality of tethers, each of said loops sized to fit over a distal end of an umbrella spine.

7. The device of claim 6 further including a buckle located between said loop and said ring, said buckle is used to adjust the length of each of said tethers.

8. The device of claim 6 wherein said fasteners are hooks which connect to said loops on said plurality of tethers.

9. The device of claim 4 wherein said fasteners are coacting fasteners from the group comprising buttons, snaps, and tie downs.

10. The device of claim 4 further including weights located on said screening system.

* * * * *